US008277033B2

(12) United States Patent
Umeda

(10) Patent No.: US 8,277,033 B2
(45) Date of Patent: Oct. 2, 2012

(54) LIQUID-DROP EJECTING APPARATUS AND LIQUID CARTRIDGE

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 905 days.

(21) Appl. No.: 12/054,660

(22) Filed: Mar. 25, 2008

(65) Prior Publication Data

US 2008/0239040 A1 Oct. 2, 2008

(30) Foreign Application Priority Data

Mar. 27, 2007 (JP) ..... 2007-082517

(51) Int. Cl.
*B41J 2/19* (2006.01)

(52) U.S. Cl. ..... 347/92

(58) Field of Classification Search ..... 347/92
See application file for complete search history.

(56) References Cited

U.S. PATENT DOCUMENTS

| | | | | |
|---|---|---|---|---|
| 4,071,040 | A * | 1/1978 | Moriarty | 137/199 |
| 4,600,697 | A * | 7/1986 | Smernoff | 436/174 |
| 4,933,082 | A * | 6/1990 | Yamada et al. | 96/12 |
| 2003/0160848 | A1 | 8/2003 | Taniguchi et al. | |
| 2004/0174419 | A1 | 9/2004 | Ishizaki | |
| 2006/0192820 | A1* | 8/2006 | Umeda | 347/85 |
| 2006/0203047 | A1 | 9/2006 | Koga et al. | |
| 2007/0046747 | A1* | 3/2007 | Takemoto | 347/92 |

FOREIGN PATENT DOCUMENTS

| | | | |
|---|---|---|---|
| JP | 02102715 | A * | 4/1990 |
| JP | 2002-200773 | A | 7/2002 |
| JP | 2003-053995 | A | 2/2003 |
| JP | 2003-246075 | A | 9/2003 |
| JP | 2003-246077 | A | 9/2003 |
| JP | 2004009450 | A | 1/2004 |
| JP | 2004-188641 | A | 7/2004 |
| JP | 2006247936 | A | 9/2006 |

OTHER PUBLICATIONS

Japan Patent Office, Notification of Reasons for Refusal for Japanese Patent Application No. 2007-082517 (counterpart to above-captioned patent application), dispatched Jun. 28, 2011.

* cited by examiner

*Primary Examiner* — Ryan Lepisto
*Assistant Examiner* — Andrew Jordan
(74) *Attorney, Agent, or Firm* — Baker Botts L.L.P.

(57) ABSTRACT

A liquid-drop ejecting apparatus comprises: a liquid-drop ejection head, a first tank, a second tank and a negative pressure generation unit. The first tank includes: a liquid storage chamber for storing therein a liquid to be supplied to the liquid-drop ejection head; a gas chamber formed therein; a communication hole connecting the liquid storage chamber and the gas chamber; a gas-permeable membrane which covers the communication hole, and by which the liquid storage chamber and the gas chamber is divided; and a suppression member provided in the gas chamber and configured to contact with the gas-permeable membrane which is deformed to project toward an inside of the gas chamber, so as to suppress the deformation of the gas-permeable membrane. The second tank for storing therein a liquid to be supplied to the liquid storage chamber. The negative pressure generation unit configured to generate a negative pressure in the gas chamber.

17 Claims, 11 Drawing Sheets

LIQUID-DROP EJECTING APPARATUS AND LIQUID CARTRIDGE

CROSS-REFERENCE TO RELATED APPLICATION

This application claims priority from Japanese Patent Application No. 2007-082517, filed on Mar. 27, 2007, the entire subject matter of which is incorporated herein by reference.

TECHNICAL FIELD

Aspects of the present invention relate to a liquid-drop ejecting apparatus and a liquid cartridge, and more particularly, to a liquid-drop ejecting apparatus in which a gas-permeable membrane is provided with a tank for supplying a liquid and a liquid cartridge including a gas-permeable membrane.

BACKGROUND

Apparatuses such as inkjet printers or the like have a liquid-drop ejection head for ejecting liquid drops and a tank for supplying a liquid to the liquid-drop ejection head. For example, JP-A-2004-9450 describes an inkjet printer including an inkjet recording head which is mounted on a carriage and a main tank. In addition, a sub-tank is further provided on the carriage. Ink from the main tank is supplied to the inkjet recording head via the sub-tank.

In addition, an air-permeable member (a gas-permeable membrane) is provided with the sub-tank in the printer of JP-A-2004-9450. The air-permeable member is configured to not allow the ink to permeate therethrough but to selectively allow air to permeate therethrough, whereby air within the sub-tank is removed through the air-permeable member, and air and liquid are thereby separated from each other within the sub-tank. Accordingly, a problem can be suppressed that air is caused to flow into the liquid-drop ejection head's side.

However, according to the configuration described in JP-A-2004-9450, there is a fear that the air-permeable member is separated from the sub-tank or damaged when the air-permeable member is largely deformed by a pressure being applied thereto for some reason or the like.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid-drop ejecting apparatus and a liquid cartridge in which the separation of or damage to a gas-permeable membrane is suppressed even when the gas-permeable membrane is deformed.

According to an exemplary embodiment of the present invention, there is provided a liquid-drop ejecting apparatus comprising: a liquid-drop ejection head, a first tank, a second tank and a negative pressure generation unit. The liquid-drop ejection head including an ejection portion configured to eject a liquid drop. The first tank includes: a liquid storage chamber for storing therein a liquid to be supplied to the liquid-drop ejection head; a gas chamber formed therein; a communication hole connecting the liquid storage chamber and the gas chamber; a gas-permeable membrane which covers the communication hole, and by which the liquid storage chamber and the gas chamber is divided; and a suppression member provided in the gas chamber and configured to contact with the gas-permeable membrane which is deformed to project toward an inside of the gas chamber, so as to suppress the deformation of the gas-permeable membrane. The second tank for storing therein a liquid to be supplied to the liquid storage chamber in the first tank. The negative pressure generation unit configured to generate a negative pressure in the gas chamber.

According to another exemplary embodiment of the present invention, there is provided a liquid-drop ejecting apparatus comprising: a liquid-drop ejection head, a first tank, a second tank, and a negative pressure generation unit. The liquid-drop ejection head including an ejection portion configured to eject a liquid drop. The first tank includes: a liquid storage chamber for storing therein a liquid to be supplied to the liquid-drop ejection head; a gas chamber formed therein; a communication hole connecting the liquid storage and the gas chamber; a gas-permeable membrane which covers the communication hole, and by which the liquid storage chamber and the gas chamber is divided; and a suppression member provided in the gas chamber and faces the gas-permeable membrane, the suppression member being spaced apart from the gas-permeable membrane so as to be contactable to the gas-permeable membrane when the gas-permeable membrane is deformed. The second tank is for storing therein a liquid to be supplied to the liquid storage chamber in the first tank. The negative pressure generation unit is configured to generate a negative pressure is in the gas chamber.

According to a further exemplary embodiment of the present invention, there is provided a liquid cartridge comprising: a liquid storage chamber for storing a liquid therein, the liquid chamber being defined by at least an upper wall including an opening; a gas-permeable membrane provided on the upper wall to cover the opening; a gas chamber which communicates with the liquid storage chamber through the gas-permeable membrane; and a suppression member which is provided in the gas chamber, faces the gas-permeable membrane and is spaced apart from the gas-permeable membrane so as to be contactable to the gas-permeable membrane when the gas-permeable membrane is deformed.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
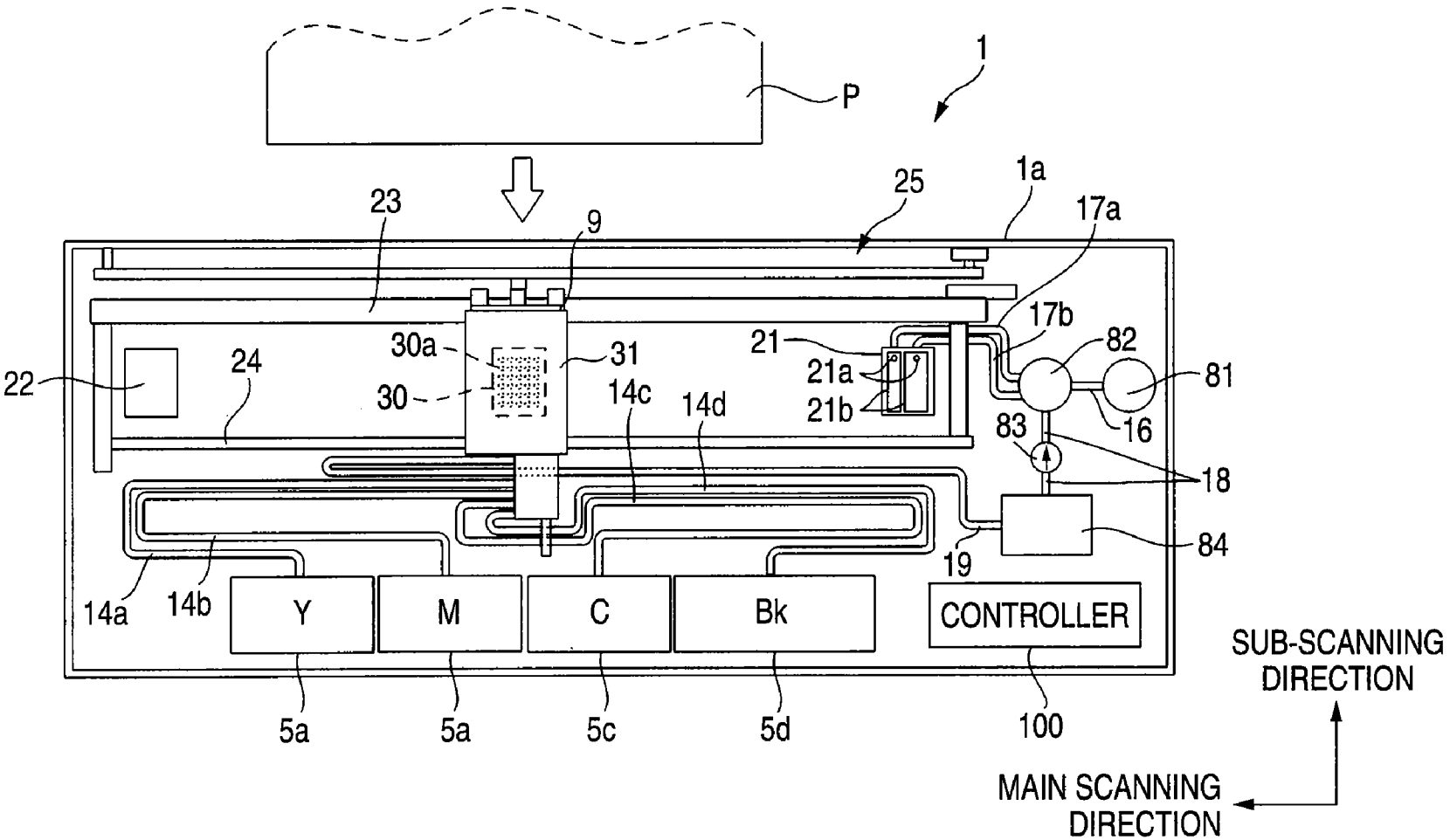
FIG. 1 is a plan view of an inkjet printer according to an exemplary embodiment of the invention.

Exemplary embodiments of the invention will be described with reference to the drawings. FIG. 1 is a plan view showing a schematic configuration of an inkjet printer according to an exemplary embodiment of the invention. In the following description, a direction directed from the right towards the left in FIG. 1 is defined as a main scanning direction, and a direction directed from the top to the bottom is defined as a sub-scanning direction.

An inkjet printer 1 has guide frames 23 and 24, and a carriage 9. The guide frames 23 and 24 are both disposed parallel to the main scanning direction and spaced apart from each other with respect to the sub-scanning direction. The carriage 9 is installed so as to extend between the guide frames 23 and 24 and is installed so as to reciprocate along the main scanning direction on the guide frames 23 and 24. A carriage moving unit 25 is installed on a main body frame 1*a* of the inkjet printer 1. The carriage moving unit 25 has a drive motor and drives the drive motor to cause the carriage 9 to reciprocate in the main scanning direction.

A head main body 30 (a liquid-drop ejection head) is fixed on to the carriage 9. A plurality of nozzles 30*a* for ejecting ink are formed on a lower surface of the head main body 30, and the head main body 30 is fixed to the carriage 9 such that these nozzles 30*a* are exposed downwards. A sub-tank 31 (a first tank), which will be described later, is fixed on to an upper surface of the head main body 30.

The inkjet printer 1 has main tanks 5*a* to 5*d* (second tanks) for supplying inks in various colors to the head main body 30. Inks of yellow (Y), magenta (M), cyan (C) and black (Bk) colors are stored in the main tanks 5*a* to 5*d*, respectively. Inks stored in the main tanks 5*a* to 5*d* are stored temporarily in the sub-tank 31 via ink tubes 14*a* to 14*d* and are thereafter supplied to the head main body 30. The inks which are supplied to the head main body 30 are then ejected downwards from the respective nozzles 30*a*. In addition, the inkjet printer 1 has a sheet conveying unit (not shown). The sheet conveying unit conveys a printing sheet P to a predetermined printing position which lies below the guide frames 23 and 24. Inks which are ejected from the head main body 30 reach the printing sheet P which is conveyed to the printing position.

The inkjet printer 1 has a controller 100 which controls various types of operations. Hardware including processor circuits, various types of storage units and the like are accommodated in the inkjet printer 1, and various types of pieces of software which include programs for operating the processor circuits are stored in the storage units. Then, the hardware and the software are combined together so as to make up the controller 100. The controller 100 forms a predetermined image on a printing sheet by controlling the conveyance of a printing sheet by the sheet conveying unit, the movement of the carriage 9 and the ejection of the inks from the head main body 30 based on image data.

A suction cap 21 and an absorbing member 22 are installed between the guide frames 23 and 24. The absorbing member 22 is disposed in the vicinity of one end (a left end as viewed in FIG. 1) of the guide frames 23 and 24 with respect to the main scanning direction, and is disposed such that the head main body 30 can be positioned directly thereabove by moving the carriage 9 with respect to the main scanning direction. The absorbing member 22 is made of porous material such as urethane foam and can absorb inks ejected from the head main body 30. The controller 100 moves the carriage 9 to a position above the absorbing member 22, causes the head main body 30 to eject inks therefrom and causes the absorbing member 22 to absorb the inks so ejected, whereby flushing operations of the nozzles 30*a* are implemented.

The suction cap 21 is disposed in the vicinity of the other end (a left end as viewed in FIG. 1) of the guide frames 23 and 24 with respect to the main scanning direction and is disposed so that the head main body 30 can be positioned directly thereabove by moving the carriage 9 with respect to the main scanning direction.

Two projecting portions 21*b* are fixed on to an upper surface of the suction cap 21 so as to project upwards therefrom. The projecting portions 21*b* each have a rectangular shape as viewed from the top. The projecting portions 21*b* are formed so as to be brought into contact with the lower surface of the head main body 30 from therebelow. When the projecting portions 21*b* are brought into contact with the lower surface of the head main body 30, the nozzles 30*a* which are formed on the lower surface of the head main body 30 are surrounded by the projecting portions as viewed from the top, whereby the suction cap 21 can cover an area on the lower surface of the head main body 30 where the nozzles 30*a* are formed. In addition, two suction ports 21*a* are formed on an upper surface of the suction cap 21. These suction ports 21*a* are formed, respectively, within the areas which are surrounded by the two projecting portions 21*b* as viewed from the top.

A suction pump 81 (a negative pressure generation unit) and a flow path switching unit 82 are installed in the inkjet printer 1. The suction pump 81 and the flow path switching unit 82 are connected to each other via an air tube 16. The flow path switching unit 82 has first to fourth ports. The first to third ports are connected, respectively, to one end of the air tube 16 and one ends of air tubes 17*a* and 17*b*, and the forth port is connected to one end of an air tube 18. The other ends of the air tubes 17*a* and 17*b* are connected to the two suction ports 21*a* formed in the suction cap 21, respectively. The flow path switching unit 82 can selectively establish a connection between the first port and any of the second to fourth ports. By this configuration, by causing the first port to communicate with, for example, the second port, a state can be realized in which the suction pump 81 can draw air from one of the suction ports 21*a* via the air tubes 16 and 17*a*. In addition, by causing the first port to communicate with the third port, a state can be realized in which the suction pump 81 can draw air from the other of the suction ports 21*a* via the air tubes 16 and 17*b*.

The controller 100 causes the suction cap 21 to cover the lower surface of the head main body 30 by causing the carriage 9 to move to the suction cap 21. Then, the controller 100 causes the inks within the nozzles 30*a* on the lower surface of the head main body 30 to be suctioned by controlling the suction pump 81 and the flow path switching unit 82 in such a state that the projecting portions 21*b* are in contact with the lower surface of the head main body 30, whereby an excess of inks lying on the peripheries of the nozzles 30*a* and air mixed into the ink flow paths are removed.

On the other hand, the other end of the air tube 18 is connected to a charge tank 84. The charge tank 84 is a hollow container and an interior thereof communicates with the air tube 18. The charge tank 84 is configured to store negative pressure therein by causing the suction pump 81 to suction in air in the interior thereof. In addition, the interior of the charge tank 84 communicates with one end of an air tube 19. The other end of the air tube 19 is connected to the sub-tank 31. As will be described later, the air tube 19 communicates with the space within the sub-tank 31, whereby by causing the flow path switching unit 82 to establish a communication between the first port and the fourth port, a state can be realized in which air within the sub-tank 31 can be suctioned in by the suction pump 81 via the air tubes 16, 18, the charge tank 84 and the air tube 19.

In addition, a one-way valve 83 is installed halfway along the length of the air tube 18. The one-way valve 83 is configured to restrict a flow of air directed from the flow path switching unit 82 towards the charge tank 84 to thereby permit only a flow air directed from the charge tank 84 towards the flow path switching unit 82, whereby air is prevented from flowing into the sub-tank 31 via the charge tank 84 and the air tube 19 even when the operation of the suction pump 81 is stopped or the flow path switching unit 82 happens to cause the ports other than the fourth port to communicate with the first port.

Figure 2:
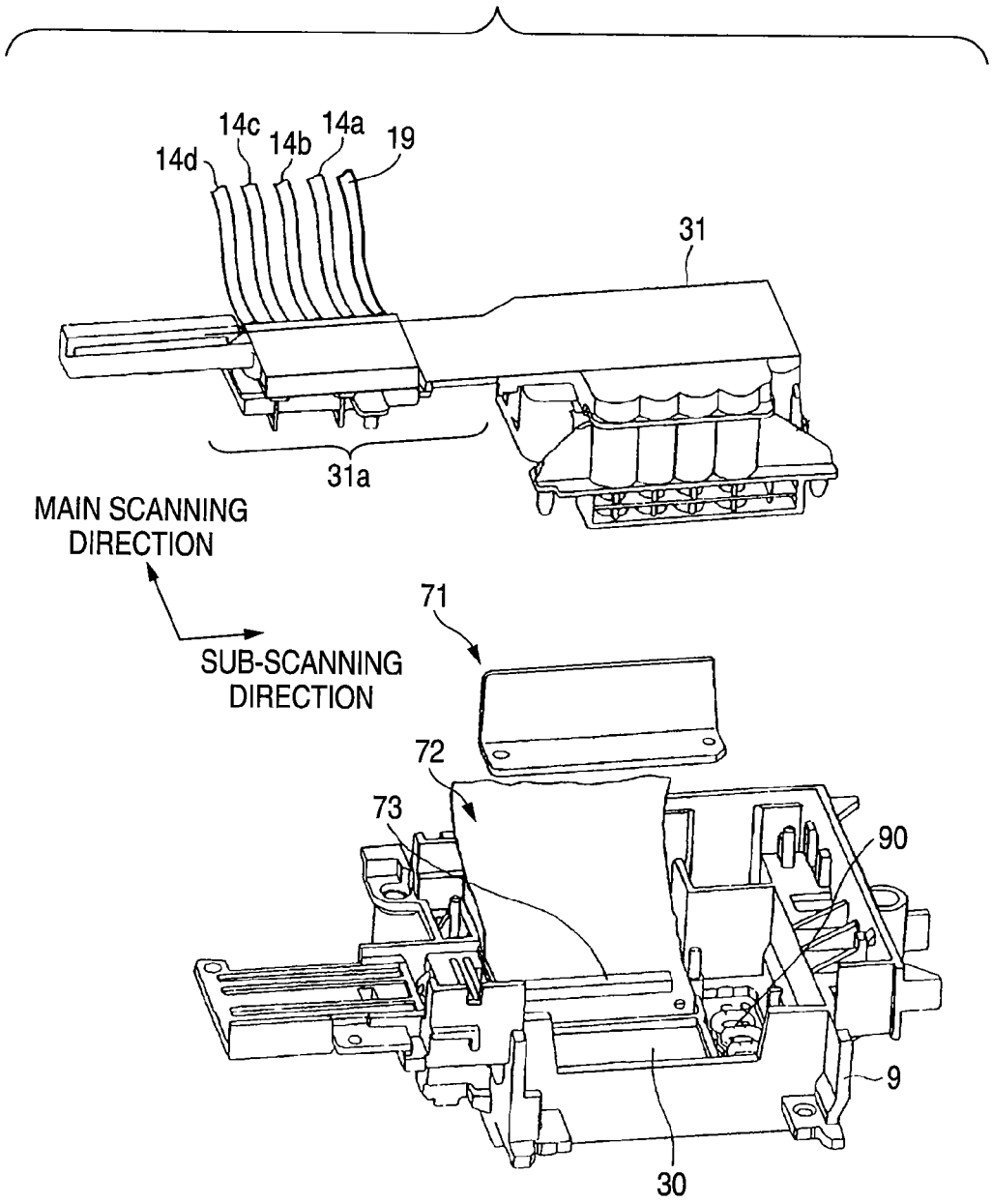
FIG. 2 is a perspective view showing a state in which a sub-tank and the like are removed from a carriage in FIG. 1.

The sub-tank 31, the head main body 30 and the carriage 9 will be described in greater detail. FIG. 2 is a perspective view showing a state in which the sub-tank 31 is removed from the carriage 9. The carriage 9 has a substantially rectangular parallelepiped shape and has a box shape which is made to open upwards. The sub-tank 31 and the head main body 30 are accommodated and fixed in place within the carriage 9.

The sub-tank 31 has an introducing portion 31*a*, and the ink tubes 14*a* to 14*d* and the air tube 19 are connected to the introducing portion 31*a*. The head main body 30 is fixed to a bottom portion of the carriage 9. An opening 90, which functions as an ink introduction port, is formed in an upper surface of the head main body 30. The opening 90 has four introduction ports which correspond to the inks of the four colors. The sub-tank 31 is accommodated above the head main body 30 within the carriage 9 so that supply ports thereof from which the inks of the respective colors are supplied from the sub-tank 31 communicate, respectively, with the introducing ports of the inks of corresponding colors.

A flexible wiring circuit board 72 is pulled out upwards from the upper surface of the head main body 30 for supplying control commands from the controller 100 to the head main body 30. A driver IC circuit 73 is installed on the flexible wiring circuit board 72. A wiring is installed on the flexible wiring circuit board 72 for transmitting a signal which signals a control command. A control signal from the controller 100 is converted into a drive signal for driving the head main body 30 by the driver IC circuit 73 and is thereafter supplied to the head main body 30.

A heat sink 71 is installed in the carriage 9 for preventing the driver IC circuit 73 from overheating. The heat sink 71 has an L-shaped cross section with respect to a cross section normal to the sub-scanning direction and is disposed so that a lower surface thereof is brought into contact with an upper surface of the driver IC circuit 73.

Figure 3:
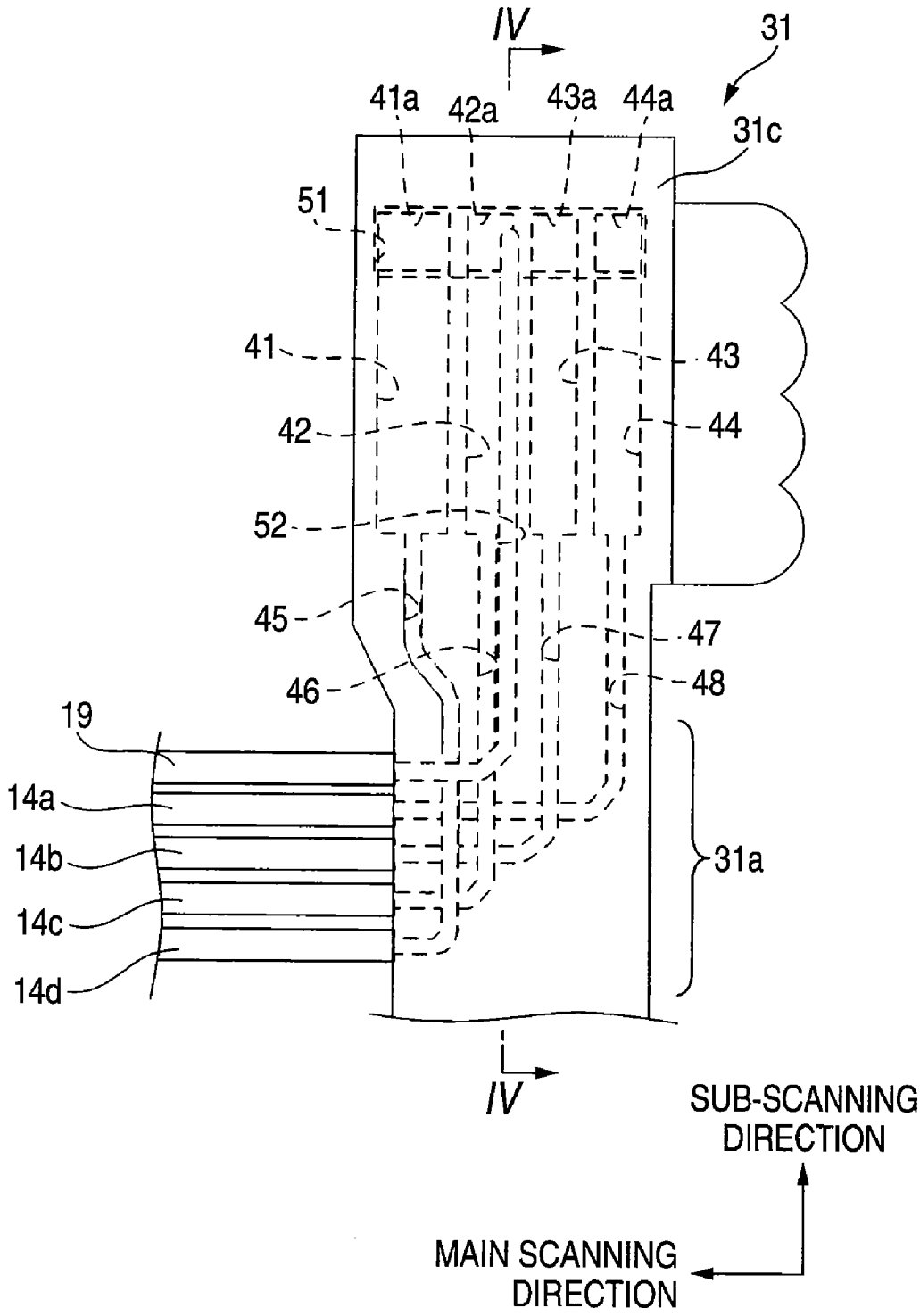
FIG. 3 is a plan view of the sub-tank shown in FIG. 1.
Figure 4A:
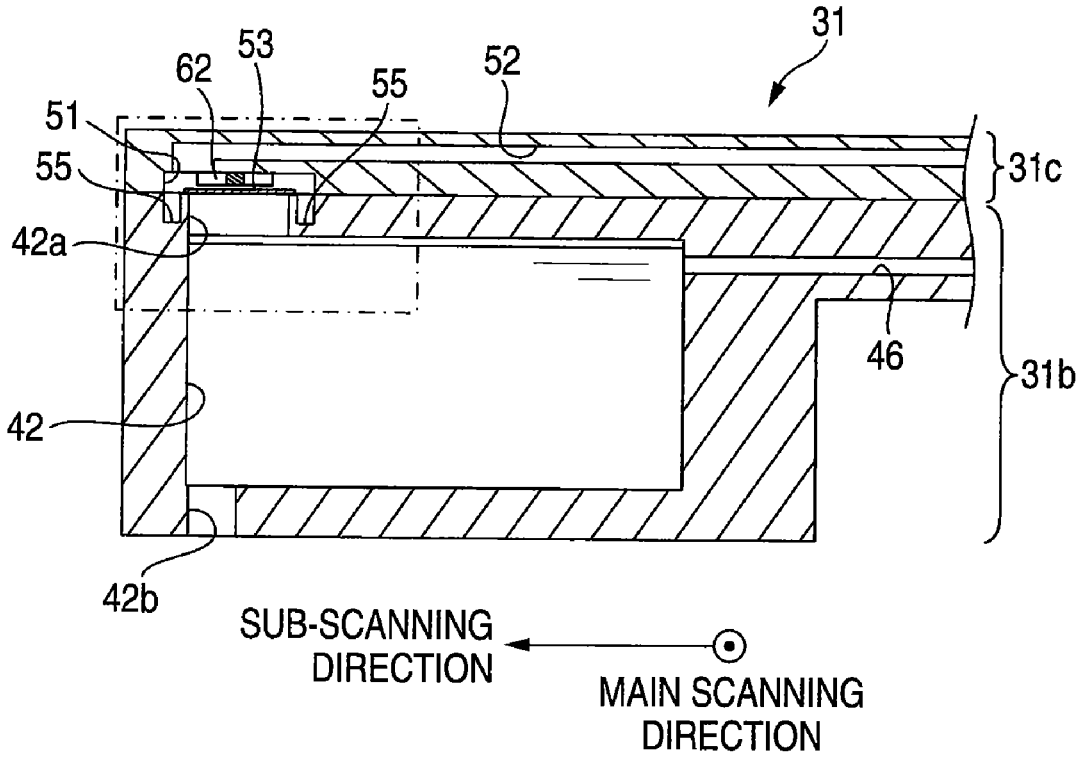
FIG. 4A is a vertical sectional view of the sub-tank taken along the line IV-IV in FIG. 3.
Figure 4B:
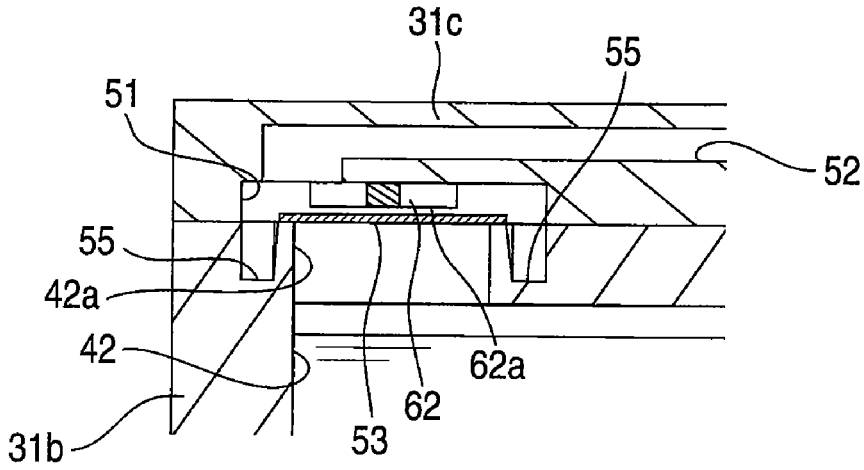
FIG. 4B is an enlarged view of an area surrounded by an alternate long and short dash line in FIG. 4A.

Hereinafter, referring to FIGS. 3 and 4, an interior configuration of the sub-tank 31 will be described. FIG. 3 is a plan view of the sub-tank 31 with an interior configuration thereof indicated by broken lines. FIG. 4A is a vertical sectional view taken along the line IV-IV in FIG. 3. FIG. 4B is an enlarged view of an area shown in FIG. 4A as being surrounded by an alternate long and short dash line.

As is shown in FIGS. 4A and 4B, the sub-tank 31 has a tank main body 31*b* and a lid member 31*c*. As is shown in FIG. 3, ink storage chambers 41 to 44 (a liquid storage chamber) in which inks are to be stored are formed within the tank main body 31*b*. In addition, ink flow paths 45 to 48 are formed within the tank main body 31*b* for introducing inks from the ink tubes 14*a* to 14*d* into the ink storage chambers 41 to 44. Inks supplied from the main tanks 5*a* to 5*d* via the corresponding ink tubes 14*a* to 14*d* flow into the ink storage chambers 41 to 44 via the ink flow paths 45 to 48. A pigment ink of Bk color and dye inks of C, M and Y colors are stored, respectively, within the ink storage chambers 41 to 44. Note that although only the ink storage chamber 42 is shown in FIGS. 4A and 4B, in the following description, unless otherwise described, the configuration of the ink storage chamber 42 shown in FIGS. 4A and 4B is understood to be common for the ink storage chambers 41 to 44.

The ink storage chambers 41 to 44 each have a substantially rectangular parallelepiped shape which is made long with respect to the sub-scanning direction and are aligned along the main scanning direction. While the ink storage chambers 42 to 44 are formed so as to have the same capacity, the ink storage chamber 41 is formed to have a larger capacity than those of the ink storage chambers 42 to 44. This is associated with the configuration of the exemplary embodiment in which dot diameters of the four colors which are formed on a sheet are made substantially identical in size with one another for the sake of a good image quality, while the pigment ink is used as the Bk color and the dye inks are used as the C, M and Y colors. Namely, by making the diameter of the nozzle which ejects the ink of Bk color which is the pigment ink difficult to sink larger than the diameters of the nozzles which eject the inks of the other colors which are the dye inks easy to sink, the sizes of dot diameters which are formed on the sheet are made to become substantially the same, and as a result, as regards the amount of ink consumed through a single discharge (the amount of ink consumed momentarily), the ink of Bk color has a larger consumption amount than those of the inks of C, M and Y colors, and therefore, in order to cope with this, the capacity of the ink storage chamber 41 where the Bk color ink is stored is made larger than those of the ink storage chambers 42 to 44 where the inks of the other colors are stored. In addition, also when the diameter of the nozzle for the Bk color ink and the diameters of the nozzles for the other colors are the same and the number of nozzles for the Bk color ink is larger than those of nozzles for the inks of the other colors, it may be good to make the capacity of the ink storage chamber 41 larger than those of the ink storage chambers 42 to 44.

In the tank main body 31*b*, communication holes 41*a* to 44*a* are formed in upper portions of the ink storage chambers 41 to 44. An upper surface of the tank main body 31*b* lies along a horizontal plane, and the communication holes 41*a* to 44*a* are all made to open to the upper surface of the tank main body 31*b*. That is, the communication holes 41*a* to 44*a* are provided on a same plane. A gas-permeable membrane 53 is affixed by means of an adhesive or the like on to the upper surface of the tank main body 31*b* so as to cover (close) the communication holes 41*a* to 44*a*. The gas-permeable membrane 53 is a membrane which allows gas to pass therethrough but does not allow other substances than gas such as ink and solids to pass therethrough, and for example, a porous fluorine plastic or the like is used for the gas-permeable membrane 53. A groove 55 (a first groove) is formed round the periphery of the gas-permeable membrane 53 on the upper surface of the tank main body 31*b*. A depth direction of the groove 55 extends in the vertical direction.

Ink flow paths 41*b* to 44*b*, which are ink supply flow paths to the head main body 30, are formed in lower portions of the ink storage chambers 41 to 44 in the tank main body 31*b*. The ink flow paths 41*b* to 44*b* communicate, respectively, with the corresponding introduction ports of the opening 90 formed in the upper surface of the head main body 30. Note that for the sake of clarity, the ink flow paths 41*b* to 44*b* are not shown in FIG. 3, and only the ink flow path 42*b* is shown in FIG. 4A.

An air chamber (a gas chamber) 51 and an air flow path 52 (a suction flow path) are formed in the lid member 31*c*. The air chamber 51 has a recessed portion which has a rectangular flat surface shape which is long with respect to the main scanning direction and is made to open to a lower surface of the lid member 31*c*. The air chamber 51 is formed to such an extent that is extends across the ink storage chambers 41 to 44 with respect to the main scanning direction (refer to FIGS. 5A to 5C) and extends from one side to the other side of the groove 55 across the gas-permeable membrane 53 with respect to the sub-scanning direction. The air chamber 51 communicates with one end of the air flow path 52. The other end of the air flow path 52 communicates with the air tube 19.

In the configuration that has been described heretofore, by causing the controller 100 to control the suction pump 81 and the flow path switching unit 82, air inside the air chamber 51 can be suctioned via the tubes 18, 19, the charge tank 84 and the air flow path 52, whereby negative pressure can be generated within the air chamber 51, and when suction continues to be applied to the air chamber 51 until negative pressure is generated to some extent within the air chamber 51, the one-way valve 83 is closed, and the negative pressure so generated in the air chamber 51 can thereby be held even in the event that the suction pump 81 is stopped. On the other hand, since the air chamber 51 is isolated from the ink storage chambers 41 to 44 via the gas-permeable membrane 53, air can be separated from inks in the ink storage chambers 41 to 44 (air-liquid separation) so as to be suctioned into the air chamber 51. By this configuration, air is prevented from flowing from the ink storage chambers 41 to 44 into the head main body 30.

Reinforcement ribs 61 to 64 (suppression member) are fixed to a ceiling surface of an inner surface of the air chamber 51 and are formed integrally of the same resin material as that of the lid member 31*c*. Note that in these reinforcement ribs, only the reinforcement rib 62 is shown in FIGS. 4A and 4B. Lower surfaces 61*a* to 64*a* (facing surface) of the reinforcement ribs 61 to 64 face the gas-permeable membrane 53 with respect to the vertical direction. The reinforcement ribs 61 to 64 are disposed so that the lower surfaces 61*a* to 64*a* thereof are spaced away from the gas-permeable membrane 53 when the gas-permeable membrane 53 is not deformed. Note that the reinforcement ribs 61 to 64 may be made of a porous material.

The upper surface of the tank main body 31*b* and the lower surface (the open surface) of the lid member 31*c* are welded to each other, and the air chamber 51 is defined by the recessed portion which is made to open to the lower surface of the lid member 31*c*, the upper surface of the tank main body 31*b* and the gas-permeable membrane 53.

Figure 5A:
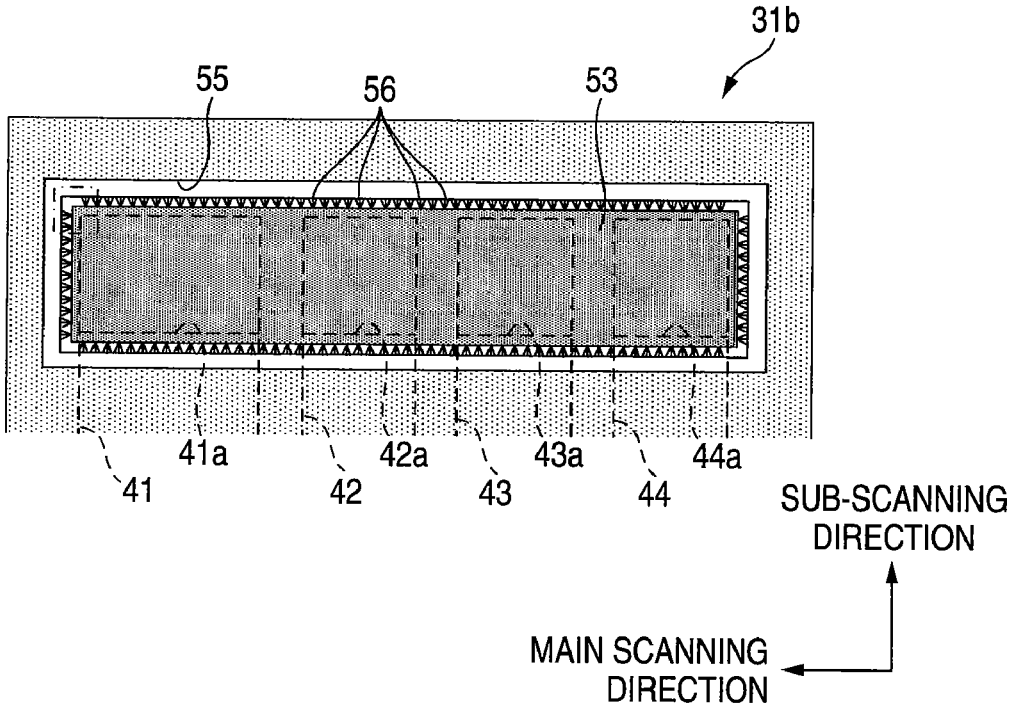
FIGS. 5A to 5C are drawings showing a configuration at an upper surface of a tank main body in FIG. 3.
Figure 5B:
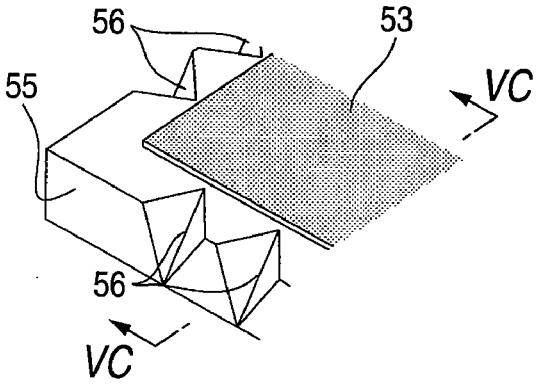
Figure 5C:
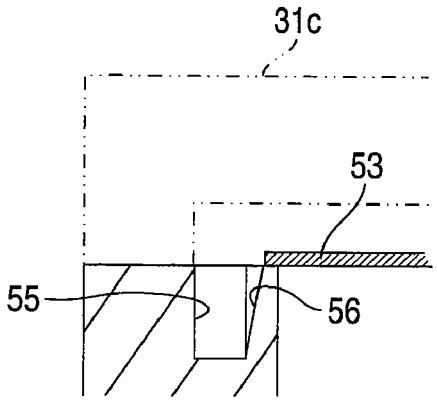

Hereinafter, a configuration on the periphery of the upper surface of the tank main body 31*b* will be described by reference to FIGS. 5A to 5C. FIG. 5A is a plan view of a portion of the tank main body 31*b* which lies in the vicinity of the gas-permeable membrane 53. FIG. 5B is a perspective view of a portion of the tank main body 31*b* which is surrounded by an alternate long and short dash line in FIG. 5A. FIG. 5C is a vertical sectional view of the tank main body 31*b* taken along the line C-C in FIG. 5B.

As is shown in FIG. 5A, the single gas-permeable membrane 53 is affixed to the upper surface of the tank main body 31*b* so as to extend across all the communication holes 41*a* to 44*a* with respect to the main scanning direction. By this configuration, the single gas-permeable membrane 53 covers openings of all the communication holes 41*a* to 44*a*. In addition, the groove 55 is formed so as to surround the periphery of the area where the gas-permeable membrane 53 is affixed. In this exemplary embodiment, the groove 55 surrounds continuously the gas-permeable membrane 53.

On the upper surface of the tank main body 31*b*, an area outside the groove 55 (in FIG. 5A, an area shaded less densely) is the area where the upper surface of the tank main body 31*b* is welded together with the lid member 31*c*. The area surrounds the periphery of the groove 55.

A large number of slits 56 (second grooves) is formed between the area where the gas-permeable membrane 53 is affixed and the groove 55. These slits 56 are arranged so as to surround the periphery of the gas-permeable membrane 53. As is shown in FIGS. 5B and 5C, the slits 56 are each formed in the upper surface of the tank main body 31*b* so as to be cut into a triangular pyramid from a portion in the vicinity of the gas-permeable membrane 53 to a bottom surface of the groove 55. In addition, the slits 56 are formed so that the slits 56 become largest in size on a gas-permeable membrane 53 side thereof and become smaller as they extend therefrom to approach the bottom surface of the groove 55. Namely, the slits 56 are each formed to have a shape in which the slit tapers as it extends from the gas-permeable membrane 53 towards the bottom surface of the groove 55.

Figure 6:
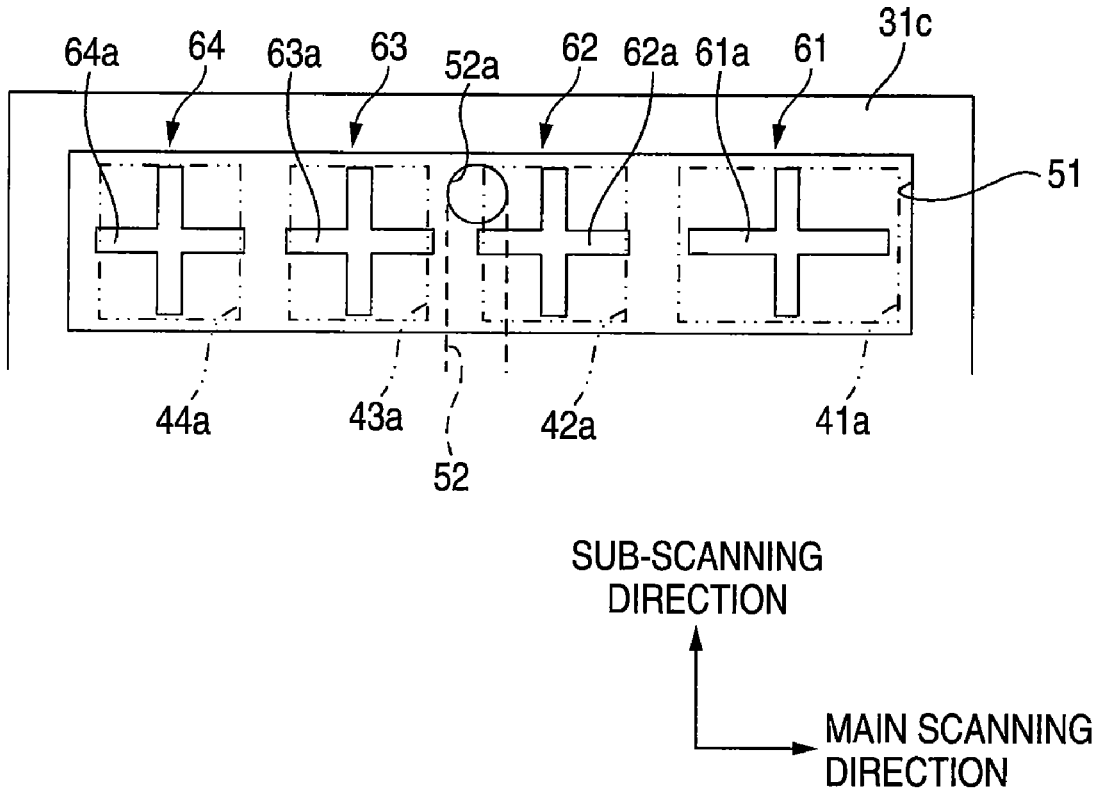
FIG. 6 is a bottom view of a portion of a lid member in FIG. 3 which is situated on the periphery of an air chamber.

Hereinafter, a configuration on the periphery of the lower surface of the lid member 31*c* will be described by reference to FIG. 6. FIG. 6 is a bottom view of a portion of the lid member 31*c* which lies on the periphery of the air chamber 51. In FIG. 6, chain double-dashed lines indicate the positions of the communication holes 41*a* to 44*a* in such a state that the lid member 31*c* is welded to the tank main body 31*b*.

As has been described above, the opening of the recessed portion is formed on the lower surface of the lid member 31*c* so as to make up the air chamber 51. In addition, the reinforcement ribs 61 to 64 are formed, respectively, in the areas in the recessed portion which faces the corresponding communication holes 41*a* to 44*a* with respect to the vertical direction. The reinforcement ribs 61 to 64 each have a cross-shape as viewed from the top and have substantially the same widths as those of the communication holes 41*a* to 44*a* with respect to the main scanning direction and the sub-scanning direction. The reinforcement ribs 62 to 64 each have the same size, but the reinforcement rib 61 has a larger width than those of the reinforcement ribs 62 to 64 with respect to the main scanning direction. This is because the ink storage chamber 41 storing the Bk color ink which corresponds to the reinforcement rib 61 is larger than the ink storage chambers 42 to 44 which store the inks of the other colors and the width of the communication hole 41*a* of the ink storage chamber 41 is accordingly made larger than the widths of the communication holes 42*a* to 44*a* of the ink storage chambers 42 to 44.

In addition, an opening 52*a* of the air flow path 52 is formed on a surface within the recessed portion which makes up the air chamber 51. The opening 52 is made to open to an area where the reinforcement ribs 61 to 64 are not formed, and in this exemplary embodiment, the opening 52*a* is disposed in a position lying between the reinforcement ribs 62 and 63 and on a side which is closer to one side of the lid member 31*c*.

Hereinafter, a function and advantage of the exemplary embodiment will be described.

As has been described heretofore, the air-liquid separation can be implemented within the ink storage chambers 41 to 44 through the gas-permeable membrane 53 by generating negative pressure in the air chamber 51. However, when the inks intrude into the air chamber 51 due to the inks passing through the gas-permeable membrane 53 or a gap being produced in the area where the gas-permeable membrane 53 is affixed, there is caused a fear that the inks remain on the gas-permeable membrane 53 to thereby make it difficult for air to permeate through the gas-permeable membrane 53.

Figure 7A:
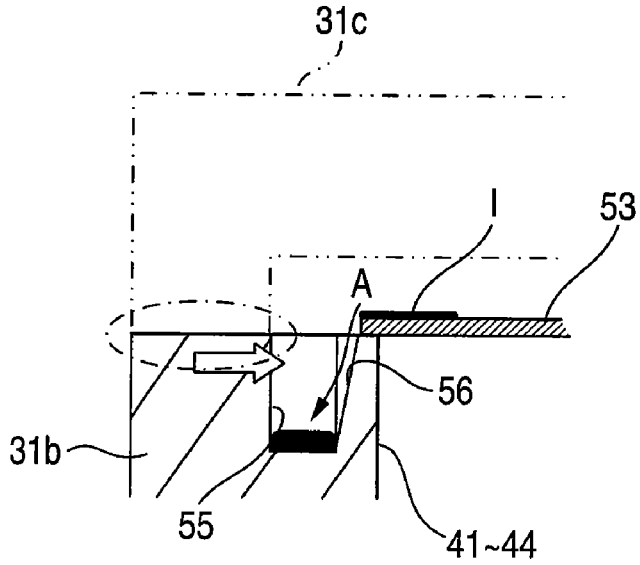
FIGS. 7A and 7B are drawings which explain a function and advantage of the exemplary embodiment.
Figure 7B:
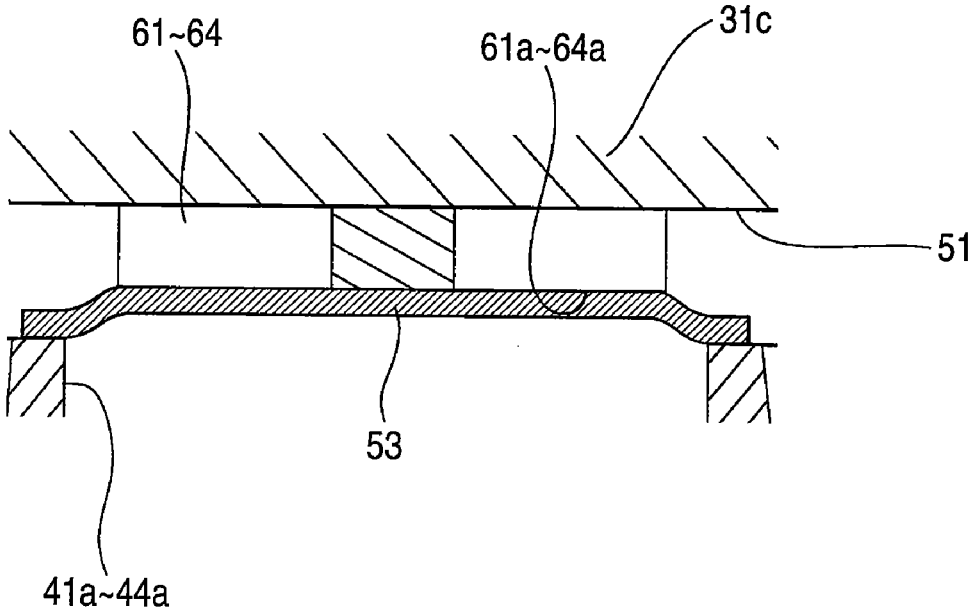

According to the exemplary embodiment, however, as is shown in FIGS. 7A and 7B, an ink I on the gas-permeable membrane 53 flows along an arrow A into the groove 55 through the slits 56. Consequently, the ink is prevented from staying on the gas-permeable membrane 53 to such an extent that the permeation of air through the gas-permeable membrane 53 is made difficult.

In addition, the formation of the slits 56 facilitates the flow of the ink into the groove 55, compared to the case where no slit 56 is formed. The slits 56 are each made to open wider on the gas-permeable membrane 53 side thereof and have the shape in which the slit tapers as it extends towards the groove 55. Consequently, the ink is made easy to flow from the gas-permeable membrane 53 into the slits 56 and is thereafter made easy to flow into the groove 55 by virtue of capillarity. Furthermore, since the large number of slits 56 is arranged so as to surround the periphery of the gas-permeable membrane 53, the ink is made easy to flow into the groove 55 from wide areas spreading on the periphery of the gas-permeable membrane 53.

In addition, according to the exemplary embodiment, the tank main body 31*b* and the lid member 31*c* are welded to each other. As this occurs, there emerges a fear that the tank main body 31*b* and the lid member 31*c* are largely deformed by heat in welding them together. In welding the tank main body 31*b* and the lid member 31*c*, there also emerges a fear that the gas-permeable membrane 53 is separated or damaged due to the deformation of the tank main body 31*b* or transmission of heat generated in welding. According to the exemplary embodiment, however, as is shown in FIG. 5A, the groove 55 is formed between the area where the welding is performed and the gas-permeable membrane 53. Consequently, even though the welding area shown as being surrounded by an alternate long and short dash line in FIG. 7A is deformed in a direction indicated by a thick white line, the propagation of deformation as far as the area where the gas-permeable membrane 53 is affixed is suppressed by the formation of the groove 55. In addition, although heat would easily be transmitted from the welding area to the area where the gas-permeable membrane 53 is affixed with no groove 55 formed, such a heat transmission is suppressed due to the existence of the groove 55.

Additionally, when air inside the air chamber 51 is suctioned out, whereby the pressure inside air chamber 51 is decreased drastically, there is caused a fear that the gas-permeable membrane 53 is deformed so as to project towards the air chamber 51. In addition, when the gas-permeable membrane 53 is deformed excessively, there is also caused a fear that the gas-permeable membrane 53 is separated from the tank main body 31*b* or is damaged. According to the exemplary embodiment, however, the reinforcement ribs 61 to 64 are disposed within the air chamber 51. Due to this, as is shown in FIG. 7B, in the event that the gas-permeable membrane 53 is deformed excessively, the reinforcement ribs 61 to 64 come into contact with the gas-permeable membrane 53 to thereby suppress the deformation of the gas-permeable membrane 53. Consequently, the separation or damage of the gas-permeable membrane 53 is suppressed.

Incidentally, when the gas-permeable membrane 53 is brought into contact with the lower surfaces 61*a* to 64*a*, air from the ink storage chambers 41 to 44 is made difficult to permeate through the area of the gas-permeable membrane 53 with which the lower surfaces 61*a* to 64*a* come into contact, compared to areas with which the lower surfaces 61*a* to 64*a* do not come into contact. However, the reinforcement ribs 61 to 64 are formed so that the lower surfaces 61*a* to 64*a* are spaced apart from the gas-permeable membrane 53 when the gas-permeable membrane 53 is not deformed. Namely, for example, in the event that there is no difference between the pressure inside the air chamber 51 and the pressures inside the ink storage chambers 41 to 44, the gas-permeable membrane 53 is not deformed, and the lower surfaces 61*a* to 64*a* of the reinforcement ribs 61 to 64 are not in contact with the gas-permeable membrane 53. Consequently, areas through which air is allowed to permeate are secured on the gas-permeable membrane 53.

In addition, since the reinforcement ribs 61 to 64 each have the cross-shape as viewed from the top, the deformation of the gas-permeable membrane 53 can be suppressed over the wide area and the areas where the reinforcement ribs 61 to 64 come into contact with the gas-permeable membrane 53 can be suppressed. Consequently, not only can the areas through which air is allowed to permeate be secured on the gas-permeable membrane 53 but also the deformation of the gas-permeable membrane 53 can be suppressed effectively.

In addition, since ink flows from the gas-permeable membrane 53 can be absorbed by the reinforcement ribs 61 to 64 in the event that the reinforcement ribs 61 to 64 are made of the porous material, the reduction in permeability of air due to the ink remaining on the gas-permeable membrane 53 is suppressed.

Additionally, since the reinforcement ribs 61 to 64 are provided so as to correspond respectively to the communication holes 41*a* to 44*a*, the deformation of the gas-permeable membrane 53 can be suppressed more appropriately.

In addition, since four air-liquid separations are implemented individually in the ink storage chambers 41 to 44 via the single air chamber 51, the air-liquid separations can be implemented in the plurality of ink chambers with the simple configuration. Furthermore, since the single gas-permeable membrane 53 is affixed so as to cover the four communication holes 41*a* to 44*a* within the single air chamber 51, the gas-permeable membrane is affixed more securely and easily with fewer labor hours than when affixing gas-permeable membranes individually to the four communication holes.

Other exemplary embodiments of sub-tanks which differ from what has been described above will be described by reference to FIGS. 8A and 8B. Note that in the following description, the description of common configurations to those of the exemplary embodiment that has been described above will be omitted appropriately and portions denoted by similar reference numerals to those of the above exemplary embodiment are understood to have the same configurations as those portions.

Figure 8A:
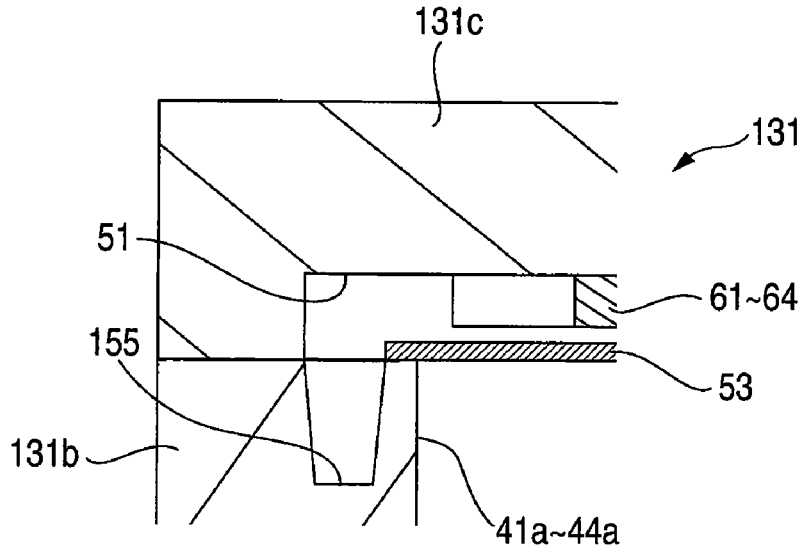
FIGS. 8A and 8B are vertical sectional views of sub-tanks according to other exemplary embodiments of the invention.

FIG. 8A is a vertical sectional view of a sub-tank 131 in which the configuration of a groove formed so as to surround a gas-permeable membrane 53 differs. The sub-tank 131 has a lid member 131*c* and a tank main body 131*b*. A groove 115 is formed in the tank main body 131*b* in place of the groove 55. As with the groove 55, the groove 155 is formed so as to continuously surround an area where the gas-permeable membrane 53 is affixed. However, the groove 155 has a vertical section which differs from that of the groove 55 and has substantially a trapezoidal shape which tapers downwards. Inner surfaces of the groove 155 are inclined as they extend from the gas-permeable membrane 53 to a bottom surface of the groove 155, whereby ink is made easier to flow downwards than the case where the groove has vertical inner surfaces.

Figure 8B:
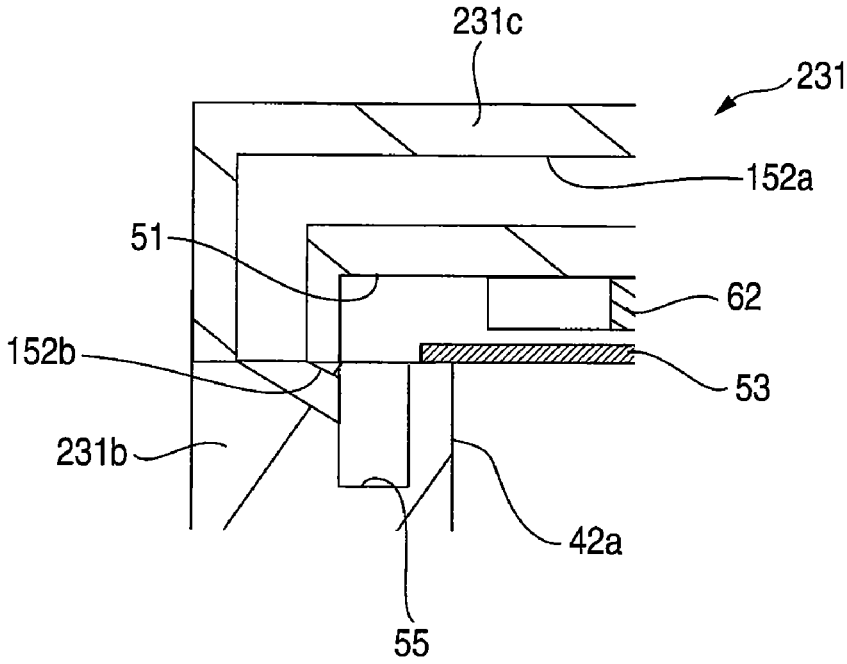

FIG. 8B is a vertical sectional view of a sub-tank 231 in which the configuration of an air flow path which communicates with an air tube 19 differs. The sub-tank 231 has a tank main body 231*b* and a lid member 231*c* and air flow paths 152*a* and 152*b* are formed in interiors of the lid member 231*c* and the tank main body 231*b*, respectively. One end of the air flow path 152*a* communicates with the air tube 19 and the other end thereof is made to open to a lower surface of the lid member 231. One end of the air flow path 152*b* is made to open to an upper surface of the tank main body 231*b* and communicates with the opening of the air flow path 152*a*. The other end of the air flow path 152*b* is made to open to an inner surface of a groove 55. In this way, due to the air flow path 152*a* communicating with a space within the groove 55, in the sub-tank 231, ink on a gas-permeable membrane 53 is suctioned into the groove 55, and the ink so accumulated to stay within the groove 55 is then suctioned out so as to be discharged by way of a route extending from the air flow path 152*a* and reaching the air tube 19. Consequently, a situation is avoided in which the ink accumulated to stay within the groove overflows to flow back on to the gas-permeable membrane 53 to thereby decrease the gas permeability of the gas-permeable membrane 53.

Figure 9A:
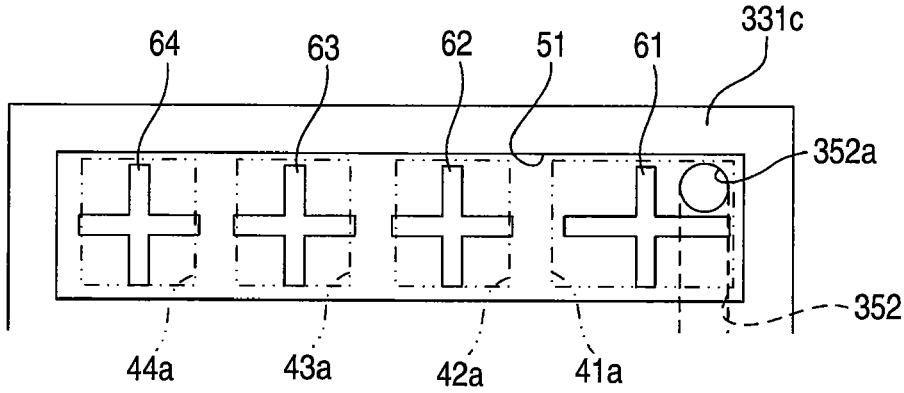
FIG. 9A to 9C are bottom views of lid members according to further exemplary embodiments of the invention.

Hereinafter, other exemplary embodiments of sub-tank lid members which differ from the lid member that has been described above will be described by reference to FIGS. 9A to 9C. FIG. 9A is a bottom view of a lid member 331*c* which differs in the opening position of an air flow path which communicates with an air tube 19. In the lid member 331, an air flow path 352 is formed in place of the air flow path 52. One end of the air flow path 352 communicates with the air tube 19 and the other end thereof is made to open to an interior of an air chamber 51. In addition, an opening 352*a* of the air flow path 352 is formed in a position lying closest to a communication hole 41*a* in communication holes 41*a* to 44*a*.

Incidentally, as has been described above, since the consumption amount (the momentarily consumed amount) of the Bk color ink at one discharge is larger than those of the other colors, in order to cope with the larger consumption amount, the capacity of the ink chamber 41 where the Bk color ink is stored is made larger than those of the ink storage chambers 42 to 44 where the inks of other colors are stored. As a result, an amount of air contained in the ink storage chamber 41 is increased over an amount of air contained in each of the ink storage chambers 42 to 44 according to an amount of ink contained therein which is larger than an amount of ink contained in each of the ink storage chambers 42 to 44.

In addition, as a result of the capacity of the ink storage chamber 41 being made larger than those of the ink storage chambers 42 to 44, the communication hole 41*a* becomes larger than the communication holes 42*a* to 44*a*, and the area of the gas-permeable membrane 53 which covers those communication holes becomes larger, whereby since the gas-permeable membrane 53 is deformed more largely in the area which covers the communication hole 41*a* than in the areas which cover the communication holes 42*a* to 44*a*, an area where the reinforcement rib 61 is brought into contact with the gas-permeable membrane 53 needs to be made larger than areas where the reinforcement members 62 to 64 are brought into contact with the gas-permeable membrane. However, since the reinforcement ribs 61 to 64 function to disturb the flow of air within the air chamber 51 so as to deteriorate the absorption of air within the ink storage chambers through the gas-permeable membrane 53, the suction of air in the ink storage chamber associated with the Bk color ink which corresponds to the largest reinforcement rib 61 is most affected.

In the lid member 331*c*, however, since the opening 352*a* is formed in the position which lies closer to the ink storage chamber 41 than the ink storage chambers 42 to 44, even in the event that the reinforcement ribs 61 to 64 are formed, air can be suctioned out quickly and smoothly from the ink storage chamber 41. In addition, from the viewpoint of air being suctioned out quickly from the ink storage chamber 41, as is shown in FIG. 9A, the opening 352*a* is preferably formed in a position which overlaps an area which corresponds to the communication hole 41*a*, whereby air is auctioned out from the ink storage chamber 41 more easily.

Figure 9B:
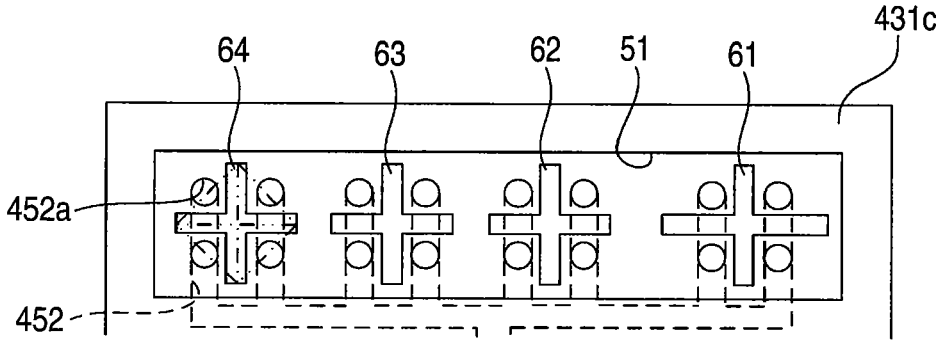

FIG. 9B is a bottom view of a lid member 431*c* in which the configuration of air flow path which communicates with an air tube 19 differs. An air flow path 452 which communicates with the air tube 19 at one end thereof is formed in the lid member 431*c*. The other end of the air flow path 452 is made to branch into a plurality of air flow ports which are made to open to an interior of an air chamber 51. Four openings 452*a* are provided in the vicinity of each of reinforcement ribs for the air flow path 452 so configured. How to provide openings will be described in relation to a reinforcement rib 64. When drawing six lines (chain double-dashed lines in FIG. 9B) so as to connect leading ends of the reinforcement rib 64, four triangular areas surrounded by the six lines are drawn. In addition, four openings 452*a* are formed so as to overlap individually the four areas. In addition, four openings 452*a* are similarly formed for each of other reinforcement ribs 61 to 63. Due to the openings 452*a* being formed in the vicinity of each of the reinforcement ribs 61 to 64 in this way, even when the reinforcement ribs 61 to 64 come into contact with a gas-permeable membrane 53, air is allowed to be still suctioned out with ease from the peripheries of the areas where the reinforcement ribs are in contact with the gas-permeable membrane.

Figure 9C:
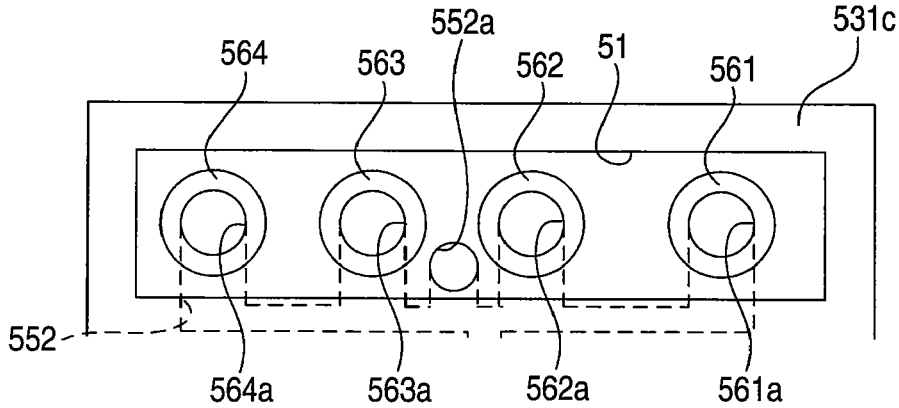

FIG. 9C is a bottom view of a lid member 531*c* in which the configurations of reinforcement ribs and an air flow path differ. Reinforcement ribs 561 to 564 are formed inside an air chamber 51 in the lid member 531*c* in place of the reinforcement ribs 61 to 64. The reinforcement ribs 561 to 564 are projecting portions which project downwards from a ceiling surface of the air chamber 51. The reinforcement ribs 561 to 564 are each formed into a cylindrical shape, and a cylindrical cavity (in-projection flow path) is formed in an interior of each of the reinforcement ribs so as to extend along a center axis thereof. The cavities are made to open to lower surfaces of the corresponding reinforcement ribs 561 to 564 to thereby form openings 561*a* to 564*a*. An air flow path 552 is formed inside the lid member 531*c* so as to communicate with an air tube 19 at one end thereof. The other end of the air flow path 552 is made to branch into a plurality of air flow ports which communicate with the cavities in the corresponding reinforcement ribs 561 to 564. Consequently, air inside the air chamber 51 is suctioned out via the openings 561*a* to 564*a*. In addition, an opening 552*a* of the air flow path 552 (out-of-projection flow path) is further formed in an area where the reinforcement ribs 561 to 564 are not formed.

In the lid member 531*c*, since the openings 561*a* to 564*a* which communicate with the air flow path 552 are formed in the lower surfaces of the reinforcement ribs 561 to 564, even in the event that the reinforcement ribs 561 to 564 and a gas-permeable membrane 53 are brought into contact with each other, air is suctioned with ease also from the areas where the reinforcement ribs are in contact with the gas-permeable membrane. In addition, since the opening 552*a* is also formed in the other area than the areas where the reinforcement ribs 561 to 564 are formed, air is suctioned out with ease through the whole area of the gas-permeable membrane 53. Furthermore, since the reinforcement ribs 561 to 564 are formed into the circular cylindrical shapes, the strength of the reinforcement ribs themselves is secured.

Other Modified Examples

While the present invention has been shown and described with reference to certain exemplary embodiments thereof, it will be understood by those skilled in the art that various changes in form and details may be made therein without departing from the spirit and scope of the invention as defined by the appended claims.

Figure 10:
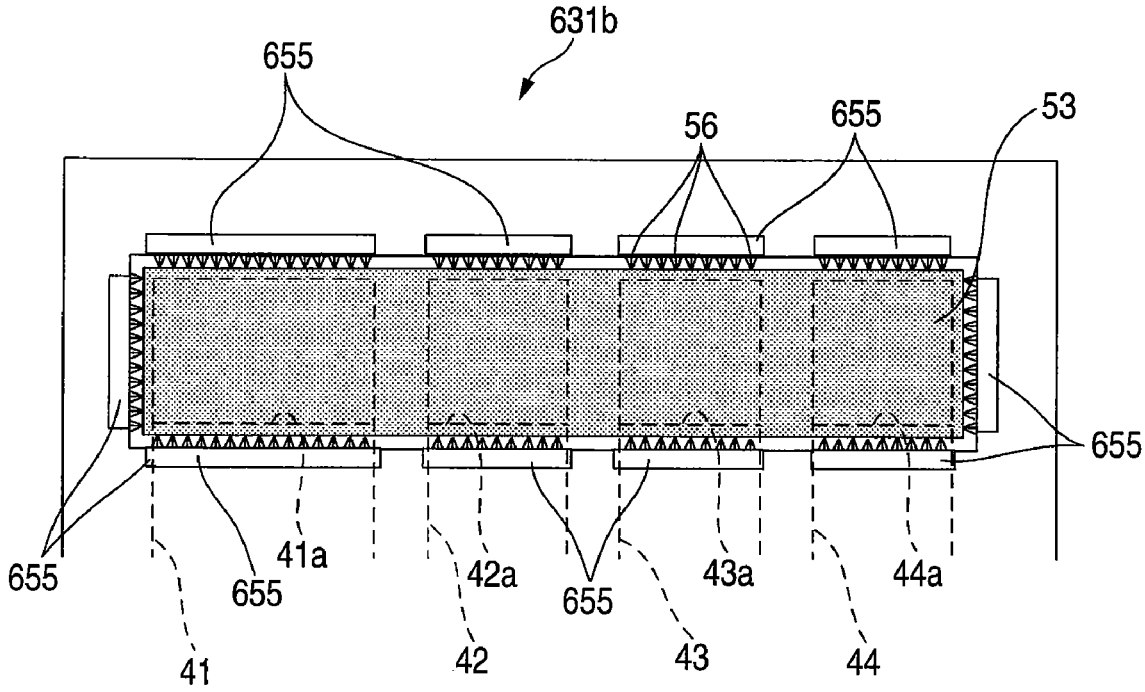
FIG. 10 is a plan view of a tank main body according to a modified example of the invention.

For example, in the exemplary embodiments, the groove 55 is formed so as to continuously surround the periphery of the area where the gas-permeable membrane 53 is affixed. However, a discontinuous groove may be formed so as to surround the periphery of the gas-permeable membrane 53. For example, FIG. 10 shows an upper surface of a tank main body 631*b* on which such a discontinuous groove or separate grooves 655 are formed. The grooves 655 are formed separately on the periphery of a gas-permeable membrane 53 in positions which confront communication holes 41*a* to 44*a*. In addition, slits 56 are also formed only in areas which correspond to the grooves 655.

In addition, slits which are different in configuration from the slits 56 may be formed. For example, each slit may be formed into a quadrangular shape as viewed from the top. Alternatively, the slit may be formed so as not to taper as it extends from the gas-permeable membrane 53 towards the bottom surface of the groove 55 but to have the same horizontal cross section at any level along the full depth thereof.

Additionally, in the exemplary embodiments, the reinforcement ribs 61 to 64 are spaced apart from the gas-permeable membrane 53 in such a state that the gas-permeable membrane 53 is not deformed. However, the reinforcement ribs may be formed so as to come into contact with the gas-permeable membrane 53 in such a state that the gas-permeable membrane 53 is not deformed.

In addition, in the exemplary embodiments, the single gas-permeable membrane 53 is affixed so as to cover all the communication holes 41*a* to 44*a*. However, two or more gas-permeable membranes 53 may be affixed. For example, in total, four gas-permeable membranes 53 may be affixed so as to cover individually the communication holes 41*a* to 44*a*.

Additionally, in the exemplary embodiments, the sub-tank 31 has the tank main body 31*b* and the lid member 31*c*. However, these separate constituent members may be formed into an integral unit from the beginning.

In addition, in the exemplary embodiments, the mode is adopted in which the head main body 30 and the sub-tank 31 move together with the carriage 9. However, a mode may be adopted in which a stationary inkjet head is used.

Figure 11:
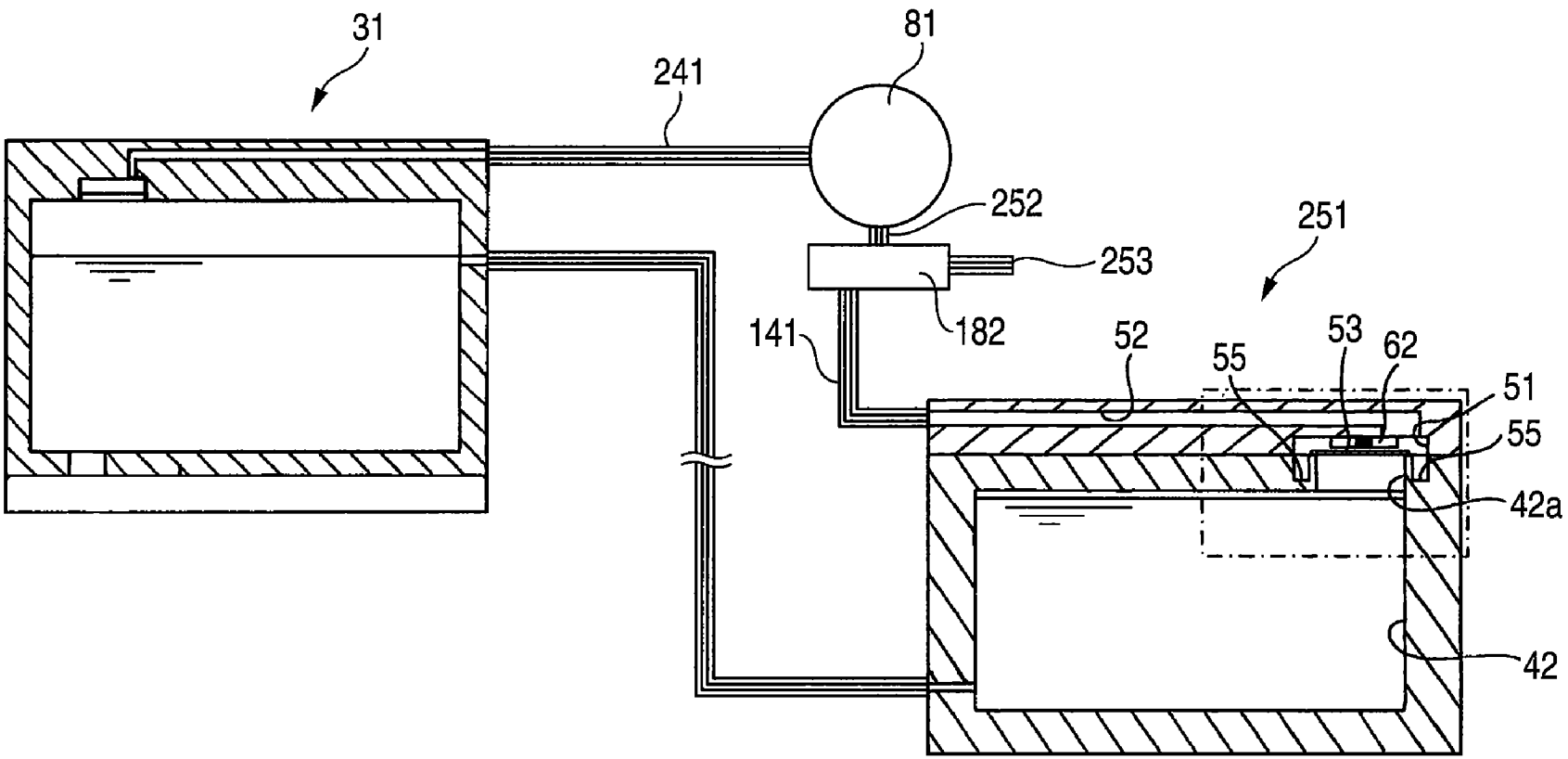
FIG. 11 is a drawing of a schematic configuration of a main tank, a sub-tank, and a suction pump according to another exemplary embodiment.

Additionally, in the exemplary embodiments, the inventive concept of the present invention is applied to the sub-tank 31. However, the inventive concept of the present invention may be applied to a main tank as an example of a liquid cartridge which is removably mountable on the inkjet printer 1. That is, the similar configuration of the sub-tank according to the exemplary embodiments as described above may be provided in the main tank. FIG. 11 shows a schematic configuration of a main tank, a sub-tank, and a suction pump, to which such main tank is applied. As shown in FIG. 11, in the main tank 251, components which are the same as those in the sub-tank described in above exemplary embodiments are denoted by same reference numerals, and descriptions thereof will be omitted.

As shown in FIG. 11, the suction pump 81 is connected to one end of an air tube 241, and the other end of the air tube 241 is connected to the sub-tank 31. The suction pump 81 is also connected to a flow path switching unit 182. The flow path switching unit 182 switches communicating states of the air flow path 52 of a main tank 251 in order to adjust the pressures in the main tank 251. The flow path switching unit 182 is configured to switch communicating states in three directions. One direction among the three directions is connected to the suction pump 81 via an air tube 252. Another one direction is communicated with the atmosphere via an air tube 253. The other one direction is connected to the air flow path 52 of the main tank 251 via an air tube 141. Then, the flow path switching unit 182 is controlled by the controller 100 so as to switch a communicating state in which the suction pump 81 and the main tank 251 are communicated with one another, and an atmosphere communicating state in which the suction pump 81 is communicated with the atmosphere.

Additionally, apart from the inkjet printer, the invention may be applied to various types of liquid ejecting apparatuses for ejecting liquid other than ink such as an apparatus for coating color liquids for production of color filters for liquid crystal displays.

The present invention provides illustrative, non limiting embodiments as follows;

A liquid-drop ejecting apparatus comprises: a liquid-drop ejection head, a first tank, a second tank and a negative pressure generation unit. The liquid-drop ejection head including an ejection portion configured to eject a liquid drop. The first tank includes: a liquid storage chamber for storing therein a liquid to be supplied to the liquid-drop ejection head; a gas chamber formed therein; a communication hole connecting the liquid storage chamber and the gas chamber; a gas-permeable membrane which covers the communication hole, and by which the liquid storage chamber and the gas chamber is divided; and a suppression member provided in the gas chamber and configured to contact with the gas-permeable membrane which is deformed to project toward an inside of the gas chamber, so as to suppress the deformation of the gas-permeable membrane. The second tank for storing therein a liquid to be supplied to the liquid storage chamber in the first tank. The negative pressure generation unit configured to generate a negative pressure in the gas chamber.

According to this configuration, there may emerges a case where the gas-permeable membrane is deformed to project towards the inside of the gas chamber due to a drastic decrease in pressure within the gas chamber occurring when the negative pressure generation unit is activated. In addition, there is a fear that the gas-permeable membrane is separated or damaged when the gas-permeable membrane is deformed excessively. However, according to this configuration, the suppression member is disposed within the gas chamber, and when the gas-permeable membrane is deformed to project towards the inside of the gas chamber, the suppression member comes into contact with the gas-permeable membrane so as to suppress the deformation thereof. Consequently, the separation of or damage to the gas-permeable membrane is suppressed.

The suppression member may include a facing surface which faces the gas-permeable membrane and which is configured to contact with the gas-permeable membrane which is deformed to project towards the inside of the gas chamber. The facing surface and the gas-permeable membrane may be spaced apart from each other when a pressure in the gas chamber and a pressure in the liquid storage chamber is substantially same.

According to this configuration, since the facing surface is spaced apart from the gas-permeable membrane when the gas-permeable membrane is not deformed, the area where gas is allowed to permeate is secured on the gas-permeable membrane.

An inner surface of the gas chamber may include a facing area which faces a surface of the gas-permeable membrane. The suppression member may include a projecting portion which projects from the facing area towards the gas-permeable membrane in a projecting direction. The facing surface may be provided at an end of the projecting portion in the projecting direction.

According to this configuration, the excessive deformation of the gas-permeable membrane is suppressed due to the projecting portion coming into contact with the gas-permeable membrane.

The first tank may further include a suction flow path provided therein. The negative pressure generation unit may generate a negative pressure in the gas chamber via the suction flow path. The suction flow path may include an opening formed within the facing area of the inner surface of the gas chamber and where the projecting portion is not provided.

According to the configuration described above, since the opening of the suction flow path is formed so to avoid the projecting portion, air inside the liquid storage chamber is easily suctioned out through the gas-permeable membrane.

The projecting portion may include a cross shape when viewed in a direction orthogonal to the surface of the gas-permeable membrane.

According to this configuration, since the projecting portion has the cross-shape, when the gas-permeable membrane is deformed, the deformation can be prevented from spreading over a wide area while suppressing the increase in contact area. When the increase in contact area is suppressed, the area on the gas-permeable membrane where gas is allowed to permeate is secured.

The suction flow path may include four of suction flow paths, each including an opening. The four openings may overlap with four areas, respectively, which are defined by six lines connecting four tops of the cross shape one another, when view in the direction orthogonal to the surface of the gas-permeable membrane.

Although when the projecting portion comes into contact with the gas-permeable membrane, gas is made difficult to permeate through the gas-permeable membrane, according to the configuration described above, since the openings of the suction flow path are formed close to the cross-shape projecting portion, gas is easily suctioned out.

The first tank may further include a plurality of suction flow paths provided therein, each of the suction flow paths including an opening. The negative pressure generation unit may generate a negative pressure in the gas chamber via the suction flow paths. The suction flow paths may include: an in-projection flow path which penetrates through the projecting portion in the projecting direction and has the opening in the facing surface; and an out-of-projection flow path which has the opening within the facing area of the inner surface of the gas chamber and where the projecting portion is not formed.

According to this configuration, since the openings of the suction flow paths are formed in the facing area at the distal end of the projecting portion, gas is easily suctioned out also from the area where the projecting portion and the gas-permeable membrane are in contact with each other. In addition, since the opening of the suction flow path is formed in the area other than the area facing the projecting portion, air is easily suctioned out through the whole area of the gas-permeable membrane.

The projecting portion in which the in-projection flow path is formed may have a cylindrical shape including a center axis extending along the projecting direction.

According to this configuration, since the cross section of the projecting portion is circular, the strength of the projecting portion itself is secured.

The first tank may include: a plurality of liquid storage chambers; and a plurality of communication holes which connect the plurality of liquid storage chambers to the gas chamber with each other, respectively, and which are provided on a same plane.

According to this configuration, an air-liquid separation for the plurality of liquid storage chambers can be implemented within the single gas chamber.

At least one of the plurality of liquid storage chambers may have a different capacity from those of the other liquid storage chambers. The opening of the suction flow path may be formed at a position which is closest to the communication hole associated with the liquid storage chamber having a largest capacity among the plurality of communication holes associated with the plurality of liquid storage chambers.

For example, when different types of liquids are stored individually in a plurality of liquid storage chambers and when there is a difference in ink consumption amount at a discharge (momentary ink consumption amount) due to a difference in nozzle diameter or the number of nozzles, there is a case where the capacity of the liquid storage chamber for the liquid which is consumed more is set larger. As a result, when the capacity of the liquid storage chamber is increased, the amount of gas contained in the liquid so stored in the liquid storage chamber is also increased. According to the configuration described above, however, the opening of the suction flow path is formed in the vicinity of the liquid storage chamber having the largest capacity. Consequently, gas can be suctioned out quickly and smoothly from the liquid storage chamber where gas easily remains to be accumulated.

The first tank may include a plurality of suppression members, each including a projecting portion which faces respective one of the plurality of communication holes.

According to this configuration, since the projecting portion is provided for each communication hole, the deformation of the gas-permeable membrane can be suppressed effectively.

The gas-permeable membrane is a single member and affixed to the inner surface of the gas chamber to cover the plurality of communication holes.

According to this configuration, since the single gas-permeable membrane is provided for the plurality of communication holes, the number of labor hours can be reduced and the easy affixation of the membrane is ensured, compared to a case where a gas-permeable membrane is affixed to each communication hole.

The suppression member may be made of porous material.

According to this configuration, since the suppression member can absorb liquid which sinks through the gas-permeable membrane, the reduction in gas permeability of the gas-permeable membrane by liquid remaining thereon is suppressed.

What is claimed is:

1. A liquid-drop ejecting apparatus comprising:

a liquid-drop ejection head including an ejection portion configured to eject a liquid drop;

a first tank including:

a liquid storage chamber for storing therein a liquid to be supplied to the liquid-drop ejection head;

a gas chamber formed therein;

a communication hole connecting the liquid storage chamber and the gas chamber;

a gas-permeable membrane which covers the communication hole, and by which the liquid storage chamber and the gas chamber is divided; and a suppression member provided in the gas chamber and configured to contact with the gas-permeable membrane which is deformed to project toward an inside of the gas chamber, so as to suppress the deformation of the gas-permeable membrane, wherein an inner surface of the gas chamber includes a facing area which faces a surface of the gas-permeable membrane, wherein the suppression member comprises a projecting portion which projects from the facing area towards the gas-permeable membrane in a projecting direction, and wherein a facing surface is provided at an end of the projecting portion in the projecting direction;

a second tank for storing therein a liquid to be supplied to the liquid storage chamber in the first tank; and a negative pressure generation unit configured to generate a negative pressure in the gas chamber.

2. The liquid-drop ejecting apparatus according to claim 1, wherein the facing surface of the projecting portion contacts with the gas-permeable membrane when the gas-permeable member is deformed to project towards the inside of the gas chamber, and wherein the facing surface and the gas-permeable membrane are spaced apart from each other when a pressure in the gas chamber and a pressure in the liquid storage chamber is substantially same.

3. The liquid-drop ejecting apparatus according to claim 1, wherein the first tank further includes a suction flow path provided therein;

wherein the negative pressure generation unit generates a negative pressure in the gas chamber via the suction flow path, and wherein the suction flow path includes an opening formed within the facing area of the inner surface of the gas chamber and where the projecting portion is not provided.

4. The liquid-drop ejecting apparatus according to claim 3, wherein the projecting portion includes a cross shape when viewed in a direction orthogonal to the surface of the gas-permeable membrane.

5. The liquid-drop ejecting apparatus according to claim 4, wherein the suction flow path comprises four suction flow paths, and each of the four suction flow paths comprising an opening, and wherein the four openings of the four suction flow paths respectively overlap with four areas of the suppression member, which are defined by six lines that connect four leading ends of the cross shape with one another, when viewed in the direction orthogonal to the surface of the gas-permeable membrane.

6. The liquid-drop ejecting apparatus according to claim 1, wherein the first tank further includes a plurality of suction flow paths provided therein, each of the suction flow paths including an opening, wherein the negative pressure generation unit generates a negative pressure in the gas chamber via the suction flow paths, wherein the suction flow paths include: an in-projection flow path which penetrates through the projecting portion in the projecting direction and has the opening in the facing surface; and an out-of-projection flow path which has the opening within the facing area of the inner surface of the gas chamber and where the projecting portion is not formed.

7. The liquid-drop ejecting apparatus according to claim 6, wherein the projecting portion in which the in-projection flow path is formed has a cylindrical shape including a center axis extending along the projecting direction.

8. The liquid-drop ejecting apparatus according to claim 3, wherein the first tank includes:

a plurality of liquid storage chambers; and a plurality of communication holes which connect the plurality of liquid storage chambers to the gas chamber with each other, respectively, and which are provided on a same plane.

9. The liquid-drop ejecting apparatus according to claim 8, wherein at least one of the plurality of liquid storage chambers has a different capacity from those of the other liquid storage chambers, and wherein the opening of the suction flow path is formed at a position which is closest to the communication hole associated with the liquid storage chamber having a largest capacity among the plurality of communication holes associated with the plurality of liquid storage chambers.

10. The liquid-drop ejecting apparatus according to claim 8, wherein the first tank includes a plurality of suppression members, each including a projecting portion which faces respective one of the plurality of communication holes.

11. The liquid-drop ejecting apparatus according to claim 8, wherein the gas-permeable membrane is a single member and affixed to the inner surface of the gas chamber to cover the plurality of communication holes.

12. The liquid-drop ejecting apparatus according to claim 1, wherein the suppression member is made of porous material.

13. A liquid-drop ejecting apparatus comprising:

a liquid-drop ejection head including an ejection portion configured to eject a liquid drop;

a first tank including:

a liquid storage chamber for storing therein a liquid to be supplied to the liquid-drop ejection head;

a gas chamber formed therein; a communication hole connecting the liquid storage and the gas chamber;

a gas-permeable membrane which covers the communication hole, and by which the liquid storage chamber and the gas chamber is divided; and a suppression member provided in the gas chamber and faces the gas-permeable membrane, the suppression member being spaced apart from the gas-permeable membrane so as to be contactable to the gas-permeable membrane when the gas-permeable membrane is deformed, wherein an inner surface of the gas chamber includes a facing area which faces a surface of the gas-permeable membrane, wherein the suppression member comprises a projecting portion which projects from the facing area towards the gas-permeable membrane in a projecting direction, and wherein a facing surface is provided at an end of the projecting portion in the projecting direction;

a second tank for storing therein a liquid to be supplied to the liquid storage chamber in the first tank; and a negative pressure generation unit configured to generate a negative pressure in the gas chamber.

14. A liquid cartridge comprising:

a liquid storage chamber for storing a liquid therein, the liquid chamber being defined by at least an upper wall including an opening;

a gas-permeable membrane provided on the upper wall to cover the opening;

a gas chamber which communicates with the liquid storage chamber through the gas-permeable membrane; and a suppression member which is provided in the gas chamber, faces the gas-permeable membrane and is spaced apart from the gas-permeable membrane so as to be contactable to the gas-permeable membrane when the gas-permeable membrane is deformed, wherein an inner surface of the gas chamber includes a facing area which faces a surface of the gas-permeable membrane, wherein the suppression member comprises a projecting portion which projects from the facing area towards the gas-permeable membrane in a projecting direction, and wherein a facing surface is provided at an end of the projecting portion in the projecting direction.

15. The liquid cartridge according to claim 14, further comprising a suction flow path communicating with the gas chamber and through which a negative pressure is generated in the gas chamber, wherein the suction flow path includes an opening which overlaps with at least a part of the facing area of the inner surface of the gas chamber, when viewed in the projecting direction.

16. The liquid cartridge according to claim 15, wherein the opening of the suction flow path does not overlap with the projecting portion when viewed in the projecting direction.

17. The liquid cartridge according to claim 14, wherein the suppression member is made of porous material.

* * * * *